United States Patent [19]

Shu

[11] Patent Number: 5,034,657

[45] Date of Patent: Jul. 23, 1991

[54] THERMAL-SWITCH INSTANT STARTER FOR A FLUORESCENT LIGHT

[76] Inventor: Chiang C. Shu, 293, Pei Tun Road, Taichung, Taiwan

[21] Appl. No.: 443,009

[22] Filed: Nov. 29, 1989

[51] Int. Cl.[5] ..... H01J 7/44

[52] U.S. Cl. ..... 315/58; 315/59; 315/100

[58] Field of Search ..... 315/58, 57, 59, 100, 315/104, 74, 75, 47

[56] References Cited

U.S. PATENT DOCUMENTS

| | | | |
|---|---|---|---|
| 4,322,658 | 3/1982 | Minarczyk | 315/100 |
| 4,386,296 | 5/1983 | Beck | 315/100 |
| 4,520,294 | 5/1985 | Iida | 315/59 |
| 4,672,270 | 6/1987 | Ito | 315/47 |
| 4,742,275 | 5/1988 | Ito | 315/59 |
| 4,914,354 | 4/1990 | Hammer | 315/104 |

*Primary Examiner*—Eugene R. LaRoche
*Assistant Examiner*—A. Zarabian

[57] ABSTRACT

A thermal-switch instant starter for a fluorescent light which initiates a high voltage instantly across its electrodes comprises a high voltage initiating tube including therein a fixed electrode and a movable electrode oppositely spaced from each other to form a short circuit for initiating the fluorescent light. The movable electrode is a thermal switch constantly disposed in contact with a heater element which is disposed on the fixed electrode. An SCR automatic charging and discharging circuit is connected between the fixed and movable movable electrodes and automatically control the charging and discharging process.

1 Claim, 3 Drawing Sheets

THERMAL-SWITCH INSTANT STARTER FOR A FLUORESCENT LIGHT

BACKGROUND OF THE INVENTION

1. Field of the Invention

The present invention relates to a thermal switch, specifically to a thermal-switch instant starter for a fluorescent light which can instantly initiate a high voltage across its electrodes.

2. Description of the Prior Art

As shown in FIGS. 1 and 2, the prior art hereby teaches the structure of a glow starter which comprises an insulating casing 1 having therein a high voltage initiating tube 2, being filled with compressed inert gases such as neon or argon and provided a fixed electrode 3 and a movable electrode 4. Referring to FIG. 2, the glow start is then connected with a fluorescent tube 5 and incorporated with a ballast 6 which is for initiating a high voltage across the two electrodes 3 and 4. When the power is turned on, a potential difference exists between two filaments 5*a* and 5*b* of the fluorescent tube 5 and the ballast 6, and between the fixed electrode 3 and the movable electrode 4 of the high voltage initiating tube 2 of the glow starter (GS). The fixed and movable electrodes 3 and 4 start to discharge because the power voltage is higher than the discharge voltage at the high voltage initiating tube 2. During discharging, the movable electrode 4 is gradually heated to expand to contact the fixed electrode 3. And thus, the preheating circuit is completed between the filaments 5*a* and 5*b* of the fluorescent tube 5 and the ballast 6. The filaments 5*a* and 5*b* of the fluorescent tube 5 is then gradually heated. Immediately after the connection of the electrodes 3 and 4, the discharging of the high voltage initiating tube 2 stops, then the movable electrode 4 will be gradually cool down and break off the contact. Because of the sudden change in current, a high induced voltage is created in the ballast 6 to cause the filaments 5*a* and 5*b* to discharge electrons. Finally, the fluorescent tube 5 is turned on.

According to the above-mentioned structure, the two electrodes 3 and 4 are in a normal open status, and when they are connected to form a short circuit by means of discharging process, the preheating current will be provided for the filaments 5*a* and 5*b* of the fluorescent tube 5. Only after the filaments 5*a* and 5*b* of the fluorescent tube 5 absorb a sufficient amount of heat energy, the ballast 6 can be induced by the disconnection operation of the electrodes 3 and 4 to provide a high voltage. Therefore, the fluorescent tube 5 requires more time (about 4 seconds) to be turned on. In the beginning, just after initiation, the discharging process of the electrodes 3 and 4 does not make a stable connection; and this will reduce the service life of the fluorescent tube 5.

OBJECTS OF THE PRESENT INVENTION

Accordingly, the objects of a thermal-switch instant starter for a fluorescent light are:

(a) to provide a thermal switch starter which can speed up the initiating time;

(b) to provide a thermal switch starter which can stablize the discharging process and thus prolong its life;

(c) to avoid the interrupted connection problem;

(d) to provide a secure initiating of the fluorescent tube in low temperature.

SUMMARY OF THE PRESENT INVENTION

The present invention provides a thermal-switch instant starter for a fluorescent light which is powered from an ordinary electric utility power line and comprises a high voltage initiating tube including therein a fixed electrode and a movable electrode oppositely spaced from each other to form a short circuit for initiating a fluorescent lamp. The initiating tube is filled with a predetermined proportion of compressed inert gases such as helium, neon and argon. The movable electrode is a thermal switch, and the fixed electrode has one end connected to a heater element which is constantly disposed in contact with the thermal switch of the movable electrode in normal close status. A Silicon Controlled Rectifier (SCR) automatic charging and discharging circuit is connected between the fixed and movable electrodes to automatically control the voltage charging and discharging process.

DETAILED DESCRIPTION OF THE PRESENT INVENTION

Figure 2:
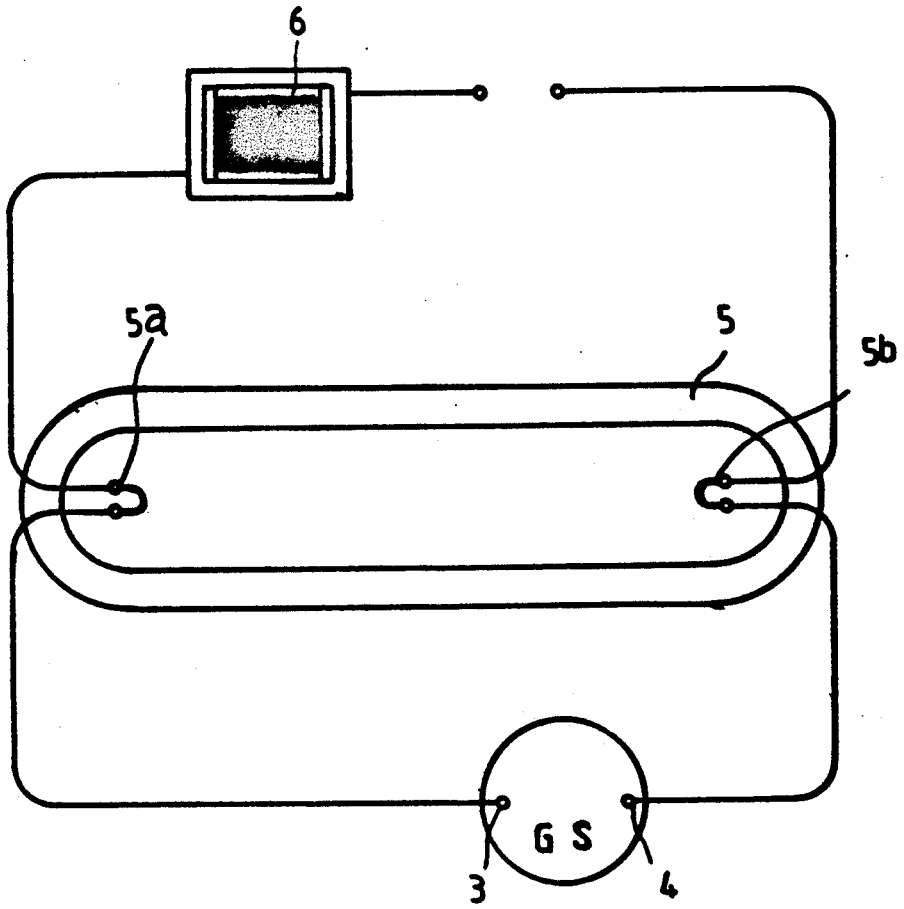
FIG. 2 is a circuit diagram of FIG. 1.
Figure 1:
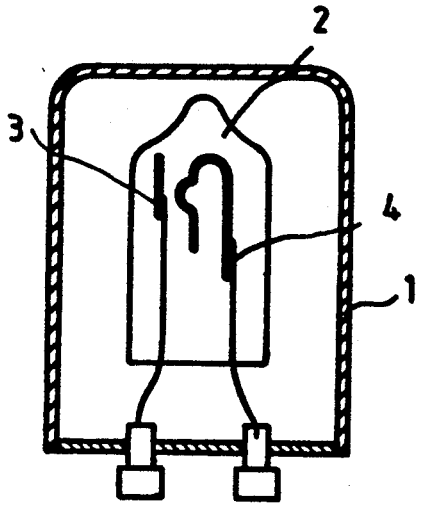
FIG. 1 is a schematic drawing shows the structure of the prior art.
Figure 3:
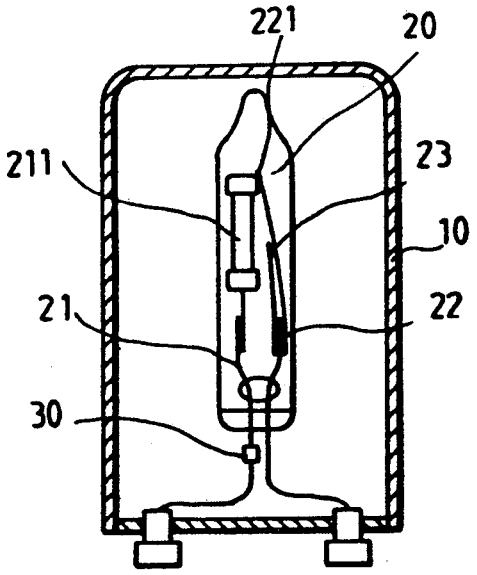
FIG. 3 is a perspective plan view of the thermal-switch instant starter for a fluorescent light.

Referring to FIG. 3, the thermal-switch instant starter for a fluorescent light comprises a housing 10 having therein a high voltage initiating tube 20, in which a fixed electrode 21 and a movable electrode 22 are disposed oppositely spaced from each other. Differing from the conventional starter, the fixed electrode 21 has one end connected with a heater element 211, which in the present embodiment, is an 8Ω resistor. Moreover, the movable electrode 22 is a metal strip in certain curvature serving as a thermal switch and has a bottom end 221 constantly disposed in contact with the heater element 211 of the fixed electrode 21. In the present embodiment, the critical temperature of the movable electrode 22 is set at 60° C. As soon as the temperature reaches 60° C., the movable electrode 22 expands and deforms, due to its different coefficient of thermal expansion, to cause its bottom end 221 to disconnect from the heater element 211. Inside the initiating tube 20 is filled with a predetermined proportion of compressed inert gases 22 such as helium, neon and argon. A metal strip element 23 which is less sensitive to heat is parallel-connected with the movable electrode 22. When temperature keeps increasing until it is over the critical temperature, i.e., 60° C., the metal strip element 23 will be deformed to separate the movable electrode 22 from the fixed electrode 21. Thus, the metal strip element is optionally provided for ensuring the separation of the movable electrode 22 from the fixed electrode 21.

Figure 4:
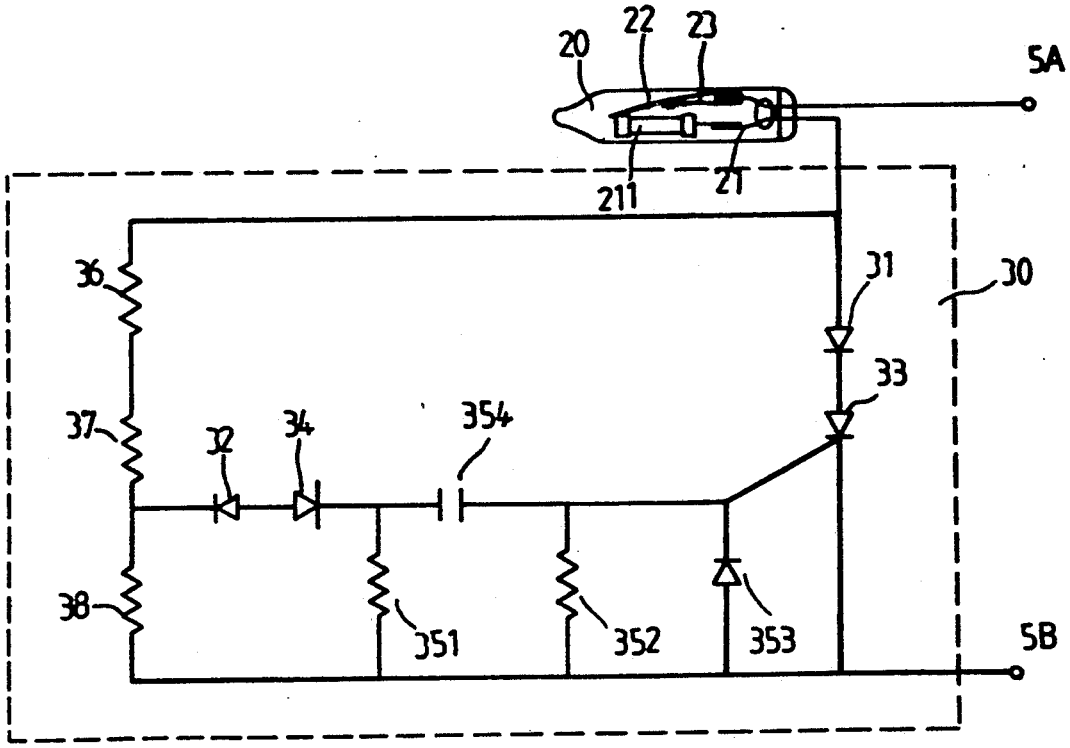
FIG. 4 is a circuit diagram of the thermal-switch instant starter for a fluorescent light.

FIG. 4 shows a Silicon Controlled Rectifier (SCR) automatic charging and discharging circuit 30 which is connected between the fixed and movable electrodes 21 and 22. The SCR automatic charging and discharging circuit 30 includes a Silicon Controlled Rectifier (SCR) 31, a diode 32, a Zener diode 33 being placed between the diode 32 and the SCR 31 and, against the diode 32. A resistance-capacitance (RC) circuit 34, being connected in series between the SCR 31 and the Zener diode 33, comprises two parallel-connected resistors 351 and 352 and a diode 353 therebetween a capacitor 354 being connected in series. According to the aforesaid arrangement, the SCR automatic charging and discharging circuit 30 enables to automatically turn on/off the SCR 31. The SCR 31 circuit is then connected in series with two resistors 37 and 36 therein each resistance is 68K/4 W so as to further increase the voltage drop.

Figure 5:
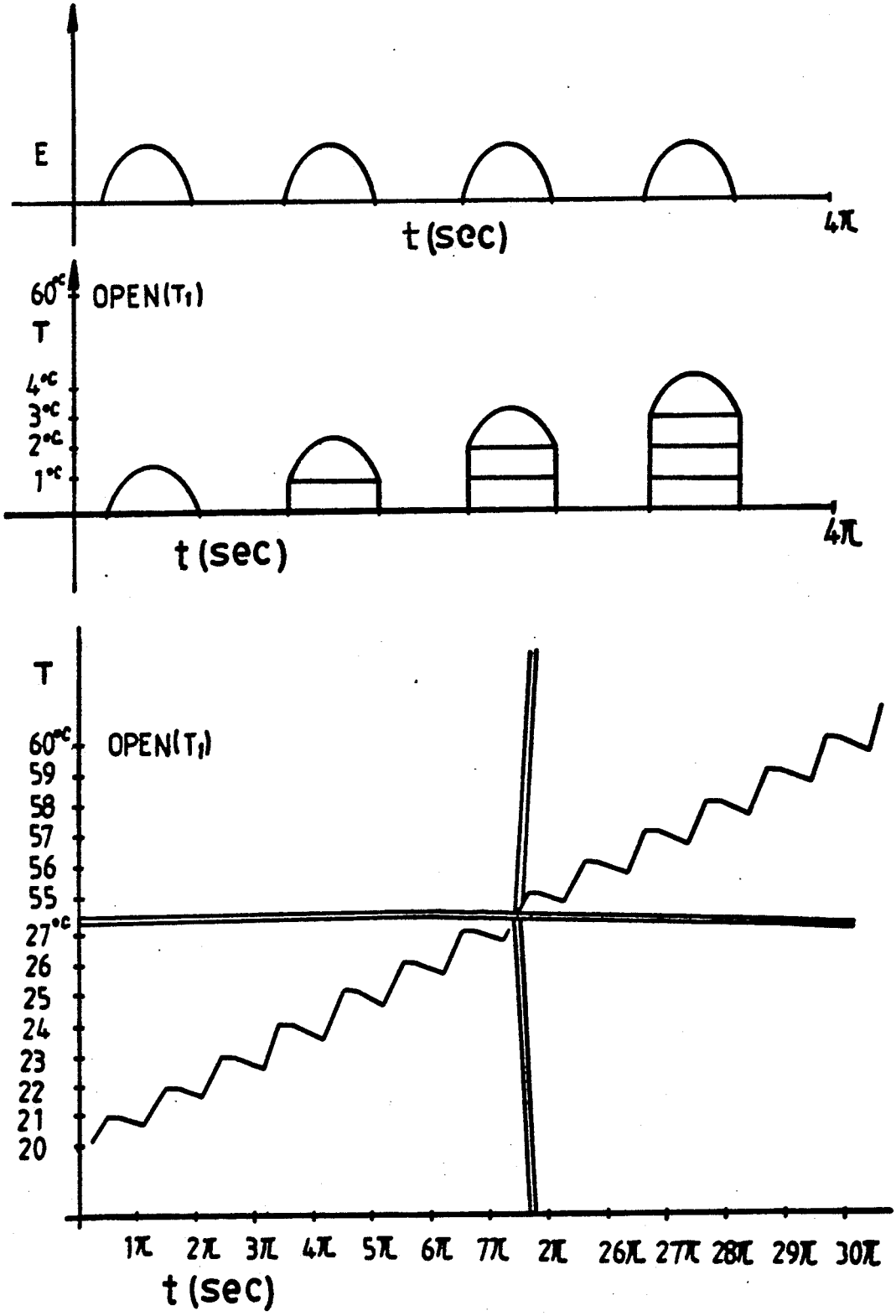
FIG. 5 is an illustrated graph of the temperature/time and the waveform of the current according to the present invention.

The thermal-switch instant starter is incorporated with a fluorescent tube 5 to initiate high voltages between its two filaments 5*a* and 5*b*. As shown in FIG. 3 and 4, the fixed and movable electrodes 21 and 22 form an open circuit when power is turned on because of their constant contact. And this permits a high voltage to pass therethrough and directly preheat the filaments 5*a* and 5*b* of the fluorescent tube 5. During the preheating process, the fixed electrode 21 is heated by conduction current to conduct the movable electrode 22. And the heat causes the ionization of the helium first, then the neon and the argon to collide each other and raise the temperature of the initiating tube 20. Since the break over temperature of the movable electrode 22 is set at 60° C., (the required heating time of the thermal switch starter approximately 0.38 second), the current circuit will be broken when the contact portion of the fixed and movable electrodes 21 and 22 is disconnected, by then the filaments 5*a* and 5*b* of the fluorescent tube 5 are heated to an extent such that the thermoelectrons are emitted. At this moment, the movable electrode 22 deforms and breaks the circuit, the ballast 6 is simultaneously induced to initiate a high voltage which forces the thermoelectrons to act on the mecury vapor of the fluorescent tube 5 to emit light. Being different from the prior art, the thermal-switch instant starter is able to directly preheat the filaments 5*a* and 5*b* and drive the movable electrode 22 to break the current circuit after the preheating process. By this means, the fluorescent tube 5 will be immediately turned on after power is applied. The circuit of the present invention is characterized, as shown in FIG. 4, in that 110/220 VAC is provided across the series-connected resistors 35 and 36 to approximately produce a voltage of 37 V at resistor 36. Referring to FIG. 5, in the beginning, the voltage does not deliver any current during the positive half cycle. During the negative half cycle, current from the resistor 36 passes through the Zener diode 33 and the diodes 32 and 353 to charge the capacitor 354, and then passes through resistors 351 and 352 to trigger the gate of the SCR 31 to allow current to flow during the positive half cycle and directly heat the filaments 5*a* and 5*b* of the fluorescent tube 5. After the thermoelectrons are ionized within the fluorescent tube 5, the remained volt of the voltage between the two filaments 5*a* and 5*b* reduces to 50–70 V and is shunted through the series-connected resistors 37 and 36. Thus, a voltage of 17–22 V is obtained from the resistor 36, and such a voltage is not sufficient to charge the capacitor 344 because it does not exceed the breakdown voltage of the Zener diode 33, so that the SCR 31 is in the nonconducting status. When the thermal switch once again make contact, current will no longer flow through the thermal switch.

The movable electrode 22 can be frequently heated and deformed to break off the contact with the fixed electrode 21, by this means, to protect the ballast 6 and the fluorescent tube 5 from damage by the continual increasing of the temperature. Because the amount of the electric current at the filaments 5*a* and 5*b* is 1.5 times that of the fluorescent tube 5 when the fluorescent tube 5 is near the end of its service life.

More over, as shown in FIG. 5, the movable electrode 22 will deform when the heating temperature raises to its breakover temperature. This is because the current will raise the temperature above the breakover temperature which is located at the maxima of its sine curve.

Further modifications of the invention herein described will occur to persons skilled in the art and all such modifications are deemed to be within the scope of the invention as defined by the appended claims.

I claim:

1. A thermal-switch instant starter for a fluorescent light comprising a high voltage initiating tube comprising therein a fixed electrode and a movable electrode oppositely spaced from each other to form a short circuit for initiating a connected fluorescent light instantly, said movable electrode being a thermal switch, said fixed electrode having an end connected with a heater element that being constantly disposed in connected with said thermal switch, an automatic charging and discharging circuit connected between said fixed electrode and said movable electrode to automatically control the voltage charging and discharging process thereof; said thermal switch made of alloy strip and deformable to disconnect from said heater element of said fixed electrode, which the critical temperature of said thermal switch being set at 60° C., and a metal strip element being relatively less sensitive to temperature and connected to said thermal switch and deformable for ensuring the separation of said thermal switch from said fixed electrode when heat fails to separate said thermal switch from said fixed electrode;

said automatic charging and discharging circuit being an SCR automatic charging and discharging circuit comprising at least two resistors being connected in series for permitting the reduction of current to a suitable range of voltage, a silicon control rectifier (SCR) circuit including therein a SCR and a diode being connected to said SCR gate in series, a zener diode being placed opposed to said diode, a resistance - capacitance (RC) circuit being formed in a series - connected manner between said SCR and said zener diode for permitting the automatic control of the operation of said SCR in non conductive status when said thermal switch being in contact once again after the fluorescent light being in operation, the RC circuit having two resistors being connected in parallel and the capacitor being connected between the two resistors and in series with the zener diode.

* * * * *